US006257243B1

(12) United States Patent
Müller et al.

(10) Patent No.: US 6,257,243 B1
(45) Date of Patent: Jul. 10, 2001

(54) SMOKING ARTICLES

(75) Inventors: Bernd-Henrik Müller, Heinersreuth; Adolf Schlüter, Eckersdorf-Donndorf; Werner Schneider, Quickorn, all of (DE); Christopher John Cook; Joseph Wanna, both of Macon, GA (US); Frank Kelley St. Charles, Perry, GA (US)

(73) Assignee: Brown & Williamson Tobacco Corporation, Louisville, KY (US)

( * ) Notice: Subject to any disclaimer, the term of this patent is extended or adjusted under 35 U.S.C. 154(b) by 0 days.

(21) Appl. No.: 09/341,545

(22) PCT Filed: Jan. 27, 1998

(86) PCT No.: PCT/GB98/00236

§ 371 Date: Sep. 9, 1999

§ 102(e) Date: Sep. 9, 1999

(87) PCT Pub. No.: WO98/32345

PCT Pub. Date: Jul. 30, 1998

(30) Foreign Application Priority Data

Jan. 28, 1997 (DE) ..... 197 03 003

(51) Int. Cl.[7] ..... A24B 1/00; A24D 1/02; A24D 3/04; A24D 1/10

(52) U.S. Cl. ..... 131/360; 131/365; 131/364; 131/341; 131/344; 131/349

(58) Field of Search ..... 131/360, 194, 131/364, 365, 331, 341, 344, 347, 349, 358, 352

(56) References Cited

U.S. PATENT DOCUMENTS

| | | | |
|---|---|---|---|
| 4,984,589 | 1/1991 | Riedesser | 131/365 |
| 5,105,838 | 4/1992 | White et al. | 131/365 |

FOREIGN PATENT DOCUMENTS

| | | |
|---|---|---|
| 38 36 210 | 10/1989 | (DE) . |
| 39 01 226 | 7/1990 | (DE) . |
| 41 27 420 | 2/1993 | (DE) . |
| 43 34 222 | 4/1995 | (DE) . |
| 0 321 740 | 6/1989 | (EP) . |
| 0 375 844 | 7/1990 | (EP) . |
| 0 413 632 | 2/1991 | (EP) . |
| 0 482 568 | 4/1992 | (EP) . |
| 0 503 461 | 9/1992 | (EP) . |
| 2 069 310 | 8/1981 | (GB) . |

*Primary Examiner*—Stanley S. Silverman
*Assistant Examiner*—Dionne A. Walls
(74) *Attorney, Agent, or Firm*—John F. Salazar; Middleton & Reutlinger

(57) ABSTRACT

The invention relates to a coaxial smoking article, particularly a coaxial cigarette, comprising a coaxial rod of smokable material, which rod has an inner segment (1) of smokable material surrounded by a covering (2), around which covering is an outer segment (3) of combustible or thermally destructible/decomposable material, which outer segment is also surrounded by a covering (4). The combustible or thermally destructible/decomposable material of the outer segment contains no or only a very small proportion of spot-forming substances. Further, the coverings of the inner and outer segments are such that spot-forming substances in the inner segment are essentially unable to reach the outside of the covering. Hence, a cigarette having reduced potential for the production of spotting is so formed.

41 Claims, 1 Drawing Sheet

SMOKING ARTICLES

Figure 1:
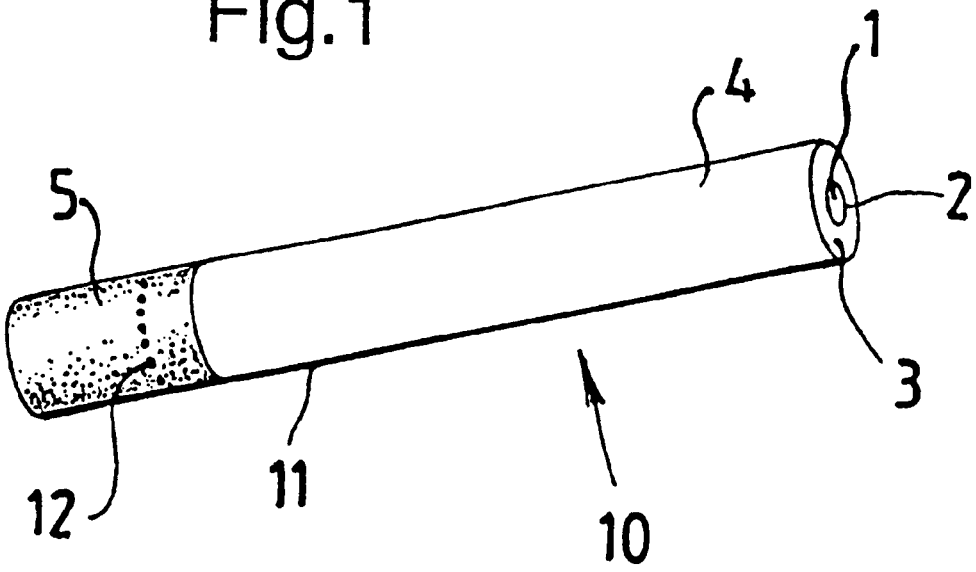

The present invention relates to smoking articles and in particular to cigarettes having reduced formation of spots and less sidestream smoke.

If cigarettes are stored for a long period of time, then formation of spots on the cigarette paper may occur. This formation of spots is caused by particular substances in or on the smokable material, which may comprise cut tobacco material, of the cigarette, which substances over a long period of time can pass through the paper to the outer surface thereof so that spots or discoloured regions form on the cigarette paper. This results in a negative visual impression to the consumer.

The smoke formed when a cigarette is smoked is typically divided between mainstream smoke and sidestream smoke. The sidestream smoke is that smoke which does not pass through the filter into the mouth of the smoker and thus is that smoke produced by the wasteful burning of the cut tobacco material. Thus, and also from the point of view of reducing the smoke passing into the surroundings, it is desirable to ensure that as small a fraction as possible of sidestream smoke is produced when a cigarette is smoked.

It is an object of the present invention to describe a cigarette which, on the one hand, is less liable to the formation of spots on the paper thereof. It is a further object to produce a cigarette which, on the other hand, produces less sidestream smoke than conventional cigarettes when smoked.

Either or both of these can be achieved by a cigarette with the characteristics in accordance with claim 1.

The secondary claims relate to specific applications of the invention.

This invention provides a cigarette formed as a coaxial cigarette with a coaxial rod of tobacco, the inner segment of which contains a smokable material which is surrounded by a covering. Around the covering of the inner segment is an outer segment of combustible or thermally destructible/decomposable material. This outer segment of combustible or thermally destructible material is surrounded by a further covering. The combustible material of the outer segment contains no, or only a small fraction of, spot-forming substances. The layers surrounding the inner segment of the coaxial strand, namely the inner covering, the outer segment and the external covering, are so constructed that the spot-forming substances which are present in the inner segment are, in principle, unable to reach the outer surface of the outer covering. This can be achieved by, for example, the inner segment being surrounded by a covering having only a very low permeability or being impermeable to spot-forming substances. Furthermore, it is also possible that the inner and outer coverings together with the external segment form a type of barrier to spot-forming substances so that, for example, substances which pass through the inner covering are taken up by the external segment and are prevented from passing therethrough. The substances are thereby prevented from reaching the external covering. In addition, it is also possible that the external covering is such that it prevents spot-forming substances which migrate through the inner covering and the external segment from reaching the outer surface of the external covering, hence no spots are formed thereon.

Materials particularly suitable for use in the outer segment are, for example, tobacco(s) having very low petroleum ether extractables. Suitable materials for the outer segment include clay materials, carbonates such as, for example, calcium carbonate, other mineral components or tobacco with a high fraction of mineral components. All such materials show no or only very slight tendency to form spots and they also ensure that only relatively few spot-forming substances can migrate from the inner segment to the outer covering.

During smoking of a cigarette, the smoke from the smokable material of the inner segment is largely consumed by the smoker. This is due to the properties of the inner covering, the outer segment and the outer covering, which are designed such that the smoke is maintained inside the coaxial rod and thus only a low amount of sidestream smoke can escape from the coaxial rod. The outer segment consists of combustible material or material that is thermally destructible such that the outer segment is degraded together with the inner segment during smoking, but only a relatively small amount or no particulate phase components are produced from the material of the outer segment.

Thus the smoke actually consumed by the smoker is that arising from the inner segment of the cigarette, while the smoke components from the combustible or thermally destructible material of the outer segment pass through the peripheral region of the cigarette. The fraction which is valueless to the smoker also has no adverse effects on, for example, the taste of the cigarette and can be removed from the smoke stream by, for example, filters.

The coaxial rod can be formed concentrically so that the inner and outer segments are circular and have a common centre point. As a person skilled in the art would readily appreciate, it is also possible that one of the two segments is elliptical or rectangular in shape. Of course, other shapes are also possible. It is important however that the inner segment is completely surrounded by the covering of the inner segment, the outer segment and the covering of the outer segment so that because of these three layers, on the one hand, the spot-forming substances from the inner segment cannot reach the outer surface of the outer covering and, on the other hand, it is ensured that when the coaxial cigarette is smoked, only relatively low amounts of the smoke produced by the material of the inner segment is lost as sidestream smoke.

The inner segment thus serves to provide smoke with an acceptable flavour while the three layers arranged around the inner segment serve to reduce or prevent the formation of sidestream smoke and to reduce or prevent the formation of spotting.

Advantageously, only the inner segment contains material(s), particularly tobacco, treated with casings, including humectants, since these materials can result in a relatively high proportion of spot-forming substances. If the material of the outer segment contains no casing(s) then the spot-forming substances in the inner segment are shielded from the outer surface of the outer covering by the three layers between them, that is to say that the three layers represent a barrier to the spot-forming substances.

Preferably the inner coaxially arranged segment contains between 5 and 40% by weight casings. If the inner segment contains, for example, 40% by weight of an aromarich casing then, because of this high proportion of casing in the inner segment, the smoke produced has a very intense flavour when the coaxial cigarette is smoked. Since in accordance with this invention the material reaching the smoker is mainly from the inner segment of the coaxial cigarette, while the material in the outer segment contributes relatively little to the smoke, the coaxial cigarette, in comparison with a conventional cigarette of the same circumference, produces the smoke to be consumed from a smaller segment of smokable material. This effect can be compensated for by the high proportion of casings and the intense flavours produced therefrom. The components usually used as casings include, for example, sugars, cocoa and liquorice.

The packing density of the smokable material in the inner segment is preferably in the range of 200 mg/cm$^3$ to 320 mg/cm$^3$, and more preferably in the range of 240 mg/cm$^3$ to 280 mg/cm$^3$. The packing density may be selected tobacco-specifically, so that in production a stable inner rod is formed.

The pressure drop in the inner segment is preferably in the range of 100 mm WG to 200 mm WG, particularly in the range of 140 mm WG to 160 mm WG.

Advantageously, the inner segment contains particularly aromatic tobacco(s) such as, for example, the so-called "Aroma Grades", at at least 40% thereof. In this way it can be ensured that smoke produced from the inner segment when the inner segment is smoked offers a particularly full flavour sensation.

The covering of the inner segment may advantageously have a low to medium air permeability, preferably 0 to 60 Coresta Units.

Preferably, the inner covering does not allow the passage of spot-forming substances therethrough, so that spot-forming substances in the inner segment cannot reach the outer segment.

Cigarettes according to the present invention have a typical diameter of about 8 mm, the radial thickness of the outer segment being not greater than 1.5 mm, and preferably not greater than 1.0–1.5 mm hence forming only a thin barrier layer. This range is arrived at on the one hand from the need for an adequately thick barrier layer and the requirements of production conditions, and on the other hand the desired proportions of flavour-relevant and flavour non-relevant materials in the segments.

It is particularly advantageous that the materials of the outer segment when smoked under standard smoking conditions and in a conventional non-coaxial cigarette, have a high inter-puff burn rate which is preferably in the range of 5 to about 15 mm per minute. Since the outer segment is surrounded by the outer covering which can have, for example, only a very low air permeability, or be impermeable or substantially impermeable to air, a high burn rate can ensure that the outer segment is not extinguished between puffs.

The material in the outer segment may have combustion-promoting substances, for example, burn promoters such as potassium citrate, so that burning in the outer segment does not cease between two sequential puffs.

The packing density of the combustible material in the outer segment which does not have a considerable potential for the formation of the particulate phase, is preferably in the range of about 80 to 180 mg/cm$^3$, and more preferably in the range of 120 to 140 mg/cm$^3$. By such a low packing density in comparison with the inner segment, the formation of potential sidestream smoke is reduced.

Consequently, it is also advantageous that the outer segment consists of combustible or thermally destructible/decomposable materials with a high fill value. This fill value can be in the range of about 4.7 to 15 cm$^3$/g.

Preferably, the outer segment comprises mineral material, i.e. inorganic fillers, or expanded tobacco lamina or tobacco stem or a mixture of these materials since, for example, expanded tobacco has, by definition a higher fill value than non-expanded tobacco.

The pressure drop in the outer segment is preferably in the range of 35 to 120 mm WG, and particularly in the range of 50 to 60 mm WG. In this manner, it can be ensured that the flow rate of the gas, e.g. smoke and/or air in the outer segment during smoking is relatively high because of the relatively small pressure drop. This results in an adequate burn rate even when a very low air permeability cigarette paper is used in its construction.

It is advantageous to select the pressure drop in the inner segment and the outer segment so that there is a high flow rate of gas in the outer segment which brings with it the advantages previously mentioned. The ratio of the pressure drop in the inner segment to that in the outer segment is preferably greater than 1, since this contributes to an increase in the flow rate in the outer segment relative to that in the inner segment.

Preferably, the outer covering is so formed that there is a reduction in sidestream smoke, and the formation of spots is reduced.

In achieving this, it is particularly useful if the outer covering of the outer segment is either impermeable or has a very low permeability to air. It is specially advantageous if this is below 15 Coresta Units. This arrangement of the outer covering has the effect that the production of sidestream smoke is further reduced.

The outer covering may contain combustion promoting substances, so that in the case of an outer covering which has only low air permeability the combustion promoting substances in the outer segment prevent the cigarette from being extinguished during the inter-puff period.

The covering of both the inner and outer segments of the coaxial rod of smokable material may consist of cigarette paper, reconstituted tobacco foil sheets or an inorganic wrapper such as that disclosed in International Patent Application No. PCT/GB95/02110.

Reference may also be made to all of the means for reducing sidestream smoke mentioned in German Patent No. 41 27 420 or German Patent No. 39 01 226.

Further the special properties of a filter applied to the tobacco rod of a coaxial cigarette as described in the two above mentioned patent specifications can also be utilised in coaxial cigarettes as described herein.

The filter can consist of one or more coaxial segments positioned, for example, adjacent to the coaxial rod. Alternatively a standard filter, that is to say a simple non-coaxial filter, can be used in conjunction with the coaxial smokable material rod. Moreover, a combination of a coaxial and a non-coaxial filter, i.e. a multiple filter or a chamber filter may, of course, be used.

If the filter comprises one or more coaxial segment(s), the coaxial segment(s) preferably has an inner filter segment, an inner filter covering which surrounds the inner filter segment, an outer filter segment which surrounds the inner filter covering and an outer filter covering of the outer filter segment. Advantageously, the inner filter covering is impermeable or has a very low permeability to air. Preferably, the outer filter covering has a ventilation zone, so that the filter can be ventilated.

It is advantageous that the pressure drop of the outer filter segment and the inner filter segment are such that the ratio of the gas flow between the outer filter segment and the inner filter segment is equal to or greater than the gas flow ratio from the outer segment to the inner segment of the coaxial rod of smokable material.

The filtration efficiency of the outer filter segment is preferably greater than that of the inner filter segment, since the smoke arising from the outer segment of the smokable rod should be mainly removed by filtration, while that from the inner coaxial segment should be delivered to the smoker having undergone a lower degree of filtration.

Furthermore, the outer filter segment has a filtration efficiency greater than 80%, and is so arranged that the total or at least the greater part of the smoke arising from the outer segment of the coaxial rod is removed by the coaxial filter.

It is particularly important that the cross-sectional areas of the inner and outer segments of the coaxial smokable rod correspond with the cross-sectional areas of the inner and outer filter segments in both size and shape.

Figure 2:
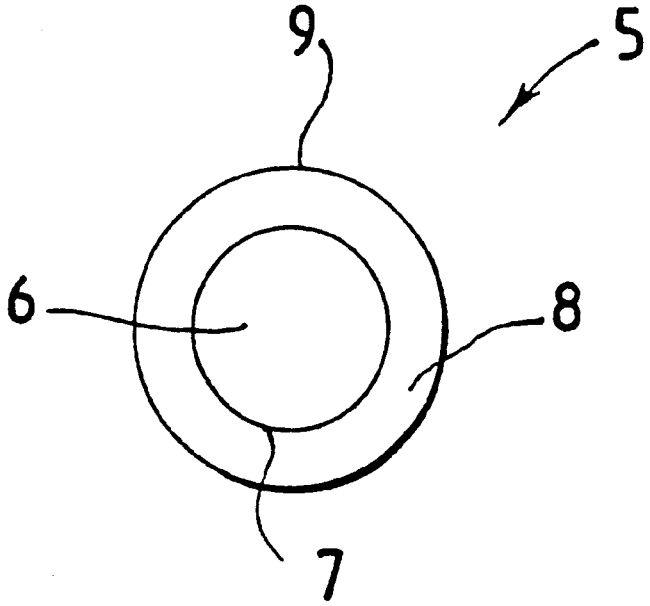

In order that the present invention may be easily understood and readily carried into effect, reference will now be made, by way of example, to the accompanying diagrammatic drawings, wherein:

FIG. 1 shows a coaxial cigarette in accordance with the invention with an attached filter, and FIG. 2 shows a cross-sectional view of a coaxial filter element.

As can be seen from FIG. 1, a coaxial cigarette 10 has a coaxial tobacco rod 11 and a filter 5. The tobacco rod 11 contains a cylindrical inner segment 1 which is surrounded by an inner covering or wrapper 2. Around the inner covering 2 there is an outer segment 3 which has a circular cross-section. The outer segment 3 is surrounded by the outer covering or wrapper 4. The filter 5 is described with reference to FIG. 2.

FIG. 2 shows an axial cross-section of the coaxial filter 5 which has an inner filter segment 6 which like the inner segment 1 of the coaxial tobacco rod 11 is cylindrical in shape and has the same cross-section. The inner filter segment 6 is surrounded by an inner covering or wrapper 7, which is surrounded by an outer filter segment 8. The outer filter segment 8 is analogous in both shape and dimension to outer segment 3 of the coaxial tobacco rod 11 and has a circular annulus or ring shaped cross-section which corresponds to the cross-section of the outer segment 3 of the coaxial tobacco rod 11. The outer filter segment 8 is surrounded by an outer covering or wrapper 9.

The inner covering 2, the outer segment 3 and the outer covering 4, form a "three-fold layer" ("triple layer") which on the one hand reduces secondary smoke and on the other hand prevents spots from forming on the outer surface of the outer covering 4.

To this end the individual components of this coaxial cigarette 10 have the following properties.

The cigarette 10 has the usual dimensions, a diameter of about 8 mm and a total length in the region of 70 mm to about 100 mm. The total length is divided between the tobacco rod 11 and filter 5 in the usual proportions.

The outer covering 4 may comprise, for example, cigarette paper manufactured by the Glatz Co. and marketed under the description GNS-40 MV which is practically impermeable to air and which contains a high proportion of burn promoters for example, potassium citrate.

The material of the outer segment 3 comprises tobacco with a low potential for the formation of particulate phase components, with a proportion of mineral substances, particularly clays, and contains no casing and/or flavour materials. To this material are added combustion accelerators such as, for example, potassium citrate. The packing density of the combustible material in the outer segment 3 is about 130 mg/cm$^3$ and its filling capabilities are about 8 cm$^3$/g.

The thickness of the annular ring-shaped outer segment 3 is about 1 mm and its pressure drop about 55 mm WG.

The covering 2 of the inner segment 1 consists of cigarette paper having an air permeability of about 25 Coresta Units. A cigarette paper yielding lower sidestream smoke may also be selected.

The inner segment 1 contains at least 40% by weight aroma grade tobacco(s), all casing materials and all humectants, of which, as an alternative, a small part can be put into the outer segment 3.

Glycerin is the preferred humectant. Its percentage quantity in the inner segment 1 is double that in usual cigarettes if, for example, the weight of the inner segment 1 is approximately 50% of the total weight of the tobacco rod 11. In this way the humectant is used particularly efficiently since only a small part passes into the surroundings via the sidestream smoke.

The construction of the filter 5 is adapted to the properties of the tobacco. If, for example, the material in the outer segment 3 has a medium or low condensate potential and produces a smoke which is neutral in taste then a standard filter can be used. This includes all known non-coaxial filters, for example, multiple filters, carbon filters, chamber filters and the like. In all other cases a coaxial filter or a multiple filter with coaxial segments must be used.

The pressure drop in the inner segment 6 and the outer segment 8 provide a flow ratio in the filter which is approximately equal to or greater than the flow ratio of the inner segment 1 and outer segment 3 of the coaxial tobacco rod 11.

The filter retention in the outer segment 8 is about 85%, while the filter retention in the inner segment 6 is less than 50%.

The filter 5 has a ventilation zone 12, the openings of which are indicated by the broken line in FIG. 1 and which extends around the filter 5. The resulting degree of ventilation is approximately 60%.

What is claimed is:

1. A coaxial cigarette comprising a coaxial rod having:

a) an inner segment of smokable material;

b) a covering for said inner segment;

c) an outer segment having tobacco material, which outer segment surrounds said covering of said inner segment; and d) a covering for said outer segment; wherein e) said material of said outer segment contains no or only a very small proportion of spot-forming substances; and f) said inner covering, outer segment and outer covering are so formed that spot forming substances in said inner segment are substantially unable to reach said outer covering.

2. A cigarette in accordance with claim 1, in which only the inner segment (1) contains tobacco treated with casing (s).

3. A cigarette in accordance with claim 1, in which only the inner segment (1) contains 5% to 40% by weight casings.

4. A cigarette in accordance with claim 1, in which the packing density of the smokable material in the inner segment (1) is about 200 to 320 mg/cmI.

5. A cigarette in accordance with claim 4, in which the packing density of the smokable material in the inner segment (1) is about 240 to 280 Mg/cm$^3$.

6. A cigarette in accordance with claim 1, in which the pressure drop in the inner segment (1) is in the range of about 100 mm WG to 200 mm WG.

7. A cigarette in accordance with claim 6, in which the pressure drop in the inner segment (1) is in the range of about 140 mm WG to 160 mm WG.

8. A cigarette in accordance with claim 1, in which the inner segment (1) contains at least 40% aromatic tobacco.

9. A cigarette in accordance with claim 1, in which the inner covering (2) consists of cigarette paper or reconstituted tobacco sheet.

10. A cigarette in accordance with claim 9, in which the inner covering (2) has low to medium air permeability.

11. A cigarette in accordance with claims 9, in which the inner covering (2) has an air permeability of 0 to 60 Coresta Units.

12. A cigarette in accordance with claim 1, in which the inner covering (2) is essentially impermeable to spot-forming substances.

13. A cigarette in accordance with claim 1, in which the radial thickness of the outer segment (3) is a maximum of 1.5 mm.

14. A cigarette in accordance with claim 1, in which the combustible material in the outer segment (3) when smoked in a conventional non-coaxial cigarette under standard conditions of smoking has a high inter-puff burn rate in the range of 5 to 15 mm/min.

15. A cigarette in accordance with claim 4, in which said material of the outer segment (3) contains burn promoters.

16. A cigarette in accordance with claim 15, in which the bum promoter is potassium citrate.

17. A cigarette in accordance with claim 16, in which the packing density of the outer segment (3) is in the range of about 120 to 140 $mg/cm^3$.

18. A cigarette in accordance with claim 17, in which the fill value is in the range of about 4.7 to 15 $cm^3/g$.

19. A cigarette in accordance with claim 18, wherein the mineral materials include inorganic fillers.

20. A cigarette in accordance with claim 19, in which the pressure drop in the outer segment (3) is in the range from about 50 to 60 mm WG.

21. A cigarette in accordance with claims 1, in which the packing density in the outer segment (3) is in the range of about 80 to 180 $Mg/cm^3$.

22. A cigarette in accordance with claim 1, in which the fraction of materials in the outer segment (3) which does not have a considerable potential for forming particulate phase constituents, has a high fill value.

23. A cigarette in accordance with claim 1, in which the outer segment (3) further contains mineral materials.

24. A cigarette in accordance with claims 1, in which the pressure drop in the outer segment (3) is in the range from about 35 to 120 mm WG.

25. A cigarette in accordance with claim 1, in which the pressure drop in the inner segment (1) and the outer segment (3) are selected so that there is a high rate of gas f low in the outer segment (3).

26. A cigarette in accordance with claim 25, in which the ratio of the pressure drop in the inner segment (1) to the pressure drop in the outer segment (3) is greater than 1.

27. A cigarette in accordance with claim 1, in which the outer covering (4) is so formed as to reduce sidestream smoke.

28. A cigarette in accordance with claim 1, in which the outer covering (4) is designed so that spot formation is reduced.

29. A cigarette in accordance with claim 28, in which the outer covering (4) consists of a thick cigarette paper.

30. A cigarette in accordance with claim 1, in which the outer covering (4) has no or only a very slight permeability to air.

31. A cigarette in accordance with claim 29, in which the air permeability of the outer covering (4) is less than 15 Coresta Units.

32. A cigarette in accordance with claim 1, in which the outer covering (4) contains combustion-promoting substances.

33. A cigarette in accordance with claims 32, in which the filter (5) has an inner filter segment (6), an inner filter covering (7) of the inner filter segment (6), an outer filter segment (8) which surrounds the inner filter covering (7) of the inner filter segment (6) and an outer filter covering (9) of the outer filter segment (8).

34. A cigarette in accordance claim 32, in which the outer filter covering (9) has a ventilation zone.

35. A cigarette in accordance with claim 33, in which the pressure drops in the outer filter segment (8) and the inner filter segment (6) are selected such that ratio of the gas flow in the outer filter segment (8) to the inner filter segment (6) is equal to or greater than the ratio of the gas flow in the outer segment (3) to the inner segment (1) of the coaxial rod (10).

36. A cigarette in accordance with claim 33, in which the filtration efficiency of the outer filter segment (8) is greater than the filtration efficiency of the inner filter segment (6).

37. A cigarette in accordance with claim 33, in which the efficiency of the outer filter segment (8) is greater than 80%.

38. A cigarette in accordance with claim 33, in which the cross-sectional areas of the inner and outer segments (1, 3) of the coaxial rod (10) correspond in size and shape with the cross-sectional areas of the inner and outer coaxial filter segments (6, 8).

39. A cigarette in accordance with claim 1, in which the cigarette has a filter (5).

40. A cigarette in accordance with claim 39, in which said filter (5) has at least one coaxial segment on the side facing the coaxial rod (10).

41. A cigarette in accordance with claim 40, in which the inner filter covering (7) of the filter (5) is impermeable or has only a very slight permeability to air.

* * * * *

UNITED STATES PATENT AND TRADEMARK OFFICE

CERTIFICATE OF CORRECTION

PATENT NO. : 6,257,243 B1
DATED : July 7, 2001
INVENTOR(S) : Cook et al.

It is certified that error appears in the above-identified patent and that said Letters Patent is hereby corrected as shown below:

Column 7, claim 11,
Line 1, change "claims 9" to -- claim 9 --

Column 7, claim 16,
Line 18, change "bum promoter" to -- burn promoter --

Column 7, claim 21,
Line 29, change "claims 1" to -- claim 1 --

Signed and Sealed this

Second Day of April, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,257,243 B1
DATED : July 10, 2001
INVENTOR(S) : Muller et al.

It is certified that error appears in the above-identified patent and that said Letters Patent is hereby corrected as shown below:

Column 7,
Line 1, change “claims 9” to -- claim 9 --;
Line 15, change "4" to -- 14 --;
Line 18, change “bum promoter” to -- burn promoter --;
Line 29, change “claims 1” to -- claim 1 --;
Line 31, change "$Mg/cm^3$" to -- $mg/cm^3$ --;
Line 38, change “claims 1” to -- claim 1 --;

Column 8,
Line 21, insert -- with -- after "accordance".

Signed and Sealed this

Nineteenth Day of August, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,257,243 B1
DATED : July 10, 2001
INVENTOR(S) : Muller et al.

It is certified that error appears in the above-identified patent and that said Letters Patent is hereby corrected as shown below:

Column 7,
Line 43, change "gas f low" to -- gas flow --.

Signed and Sealed this

Twenty-seventh Day of January, 2004

JON W. DUDAS
*Acting Director of the United States Patent and Trademark Office*